United States Patent [19]

Brinkman et al.

[11] Patent Number: 5,017,546

[45] Date of Patent: May 21, 1991

[54] ALKYL SALICYLATE DEVELOPER RESIN FOR CARBONLESS COPY PAPER AND IMAGING USE

[76] Inventors: Karl M. Brinkman, Box 12C Hudson Dr., Galway, N.Y. 12074; John L. Sullivan, 6 Hills Rd., Ballston Lake, N.Y. 12019; David R. Hanley, 102 Farmington Ave., Gansevort, N.Y. 12831

[21] Appl. No.: 552,322

[22] Filed: Jul. 13, 1990

Related U.S. Application Data

[63] Continuation of Ser. No. 184,066, Apr. 20, 1988, abandoned.

[51] Int. Cl.[5] ..... B41M 5/12; C08G 8/28

[52] U.S. Cl. ..... 503/211; 503/212; 503/216; 427/145; 427/146; 427/147; 427/150; 427/151; 430/138

[58] Field of Search ..... 503/210, 211, 212, 216; 427/145, 146, 147, 150, 151; 430/138

[56] References Cited

U.S. PATENT DOCUMENTS

| | | | |
|---|---|---|---|
| 3,723,156 | 3/1973 | Bruckett et al. | 503/212 |
| 3,772,052 | 11/1973 | Kimura et al. | 428/688 |
| 3,864,146 | 2/1975 | Oda et al. | 503/212 |
| 3,874,895 | 4/1975 | Hayashi et al. | 503/216 |
| 3,896,255 | 7/1975 | Kato et al. | 503/212 |
| 3,934,070 | 1/1976 | Kimura et al. | 503/216 |
| 4,134,847 | 1/1979 | Oda et al. | 503/212 |
| 4,219,219 | 8/1980 | Sato et al. | 503/212 |
| 4,226,962 | 10/1980 | Stolfo | 525/506 |
| 4,234,212 | 11/1980 | Kato et al. | 503/212 |
| 4,372,583 | 2/1983 | Vassiliades | 503/212 |
| 4,374,671 | 2/1983 | Hayashi et al. | 503/212 |
| 4,440,846 | 4/1984 | Sanders | 430/138 |
| 4,578,690 | 3/1986 | Veillette et al. | 503/212 |
| 4,612,254 | 9/1986 | Ginter et al. | 503/212 |
| 4,620,874 | 11/1986 | Booth, Jr. et al. | 503/212 |

FOREIGN PATENT DOCUMENTS

| | | | |
|---|---|---|---|
| 0166519 | 5/1985 | European Pat. Off. . | |
| 0194601 | 3/1986 | European Pat. Off. . | |
| 268878 | 6/1988 | European Pat. Off. | 503/212 |
| 2253772 | 11/1972 | Fed. Rep. of Germany . | |

*Primary Examiner*—Charles L. Bowers, Jr.
*Assistant Examiner*—Patrick Doody
*Attorney, Agent, or Firm*—Cushman, Darby & Cushman

[57] ABSTRACT

Phenol/aldehyde condensation products useful in the development of colored images from colorless dyes are disclosed. The phenol/aldehyde condensation products are produced by the interaction of an alkyl-substituted salicylic acid, an alkyl-substituted phenol, an aldehyde, and a metal source. The phenol/aldehyde condensation products are particularly useful in a photosensitive imaging system in which images are formed by the image-wise reaction of the developer with one or more chromogenic materials, and in carbonless copy paper systems.

19 Claims, No Drawings

ALKYL SALICYLATE DEVELOPER RESIN FOR CARBONLESS COPY PAPER AND IMAGING USE

This is a continuation of application Ser. No. 07/184,066 filed Apr. 20, 1988 now abandoned.

BACKGROUND OF THE INVENTION

1. Field of the Invention

The present invention relates to phenol/aldehyde condensation products useful in the development of colored images from colorless dyes. The condensation products are especially useful in the imaging process described in U.S. Pat. No. 4,440,846 in which images are produced by a light imaging process, and in carbonless copy paper systems.

2. Description of the Prior Art

U.S. Pat. No. 4,440,846 (the disclosure of which is hereby incorporated by reference and relied upon) discloses an imaging system in which images are formed by image-wise exposure of a photosensitive encapsulate containing a chromogenic material to actinic radiation and rupture of the capsules in the presence of a developer whereby a patterned reaction of the chromogenic material and developer is obtained which produces a contrasting image.

More specifically, U.S. Pat. No. 4,440,846 discloses an imaging system basically having:

a substrate, a chromogenic material, a photosensitive composition, a coating containing said chromogenic material and said photosensitive composition on one surface of the substrate, and a developer material which is capable of reacting with the chromogenic material to form a visible image, wherein said photosensitive composition is encapsulated in a pressure rupturable capsule as an internal phase.

In U.S. Pat. No. 4,440,846, the term "encapsulated" refers to both so-called resin dispersion or open phase systems in which the internal phase containing the photosensitive composition and optionally the chromogenic material is dispersed as droplets throughout a dispersing medium and systems in which the capsule is formed with a discrete capsular wall, the latter encapsulation typically being in the form of microcapsules. "Pressure rupturable capsules" are, accordingly, considered by U.S. Pat. No. 4,440,846 to exist in either of these "encapsulated" systems. Furthermore, while the capsules are described as being "pressure rupturable" other means than pressure may be used to rupture them.

In accordance with U.S. Pat. No. 4,440,846, images are formed by exposing the coated composition containing the chromogenic material and the encapsulated photosensitive composition to actinic radiation and rupturing the capsules in the presence of a developer. The invention system is designed such that when these steps are carried out, the image-forming reaction between the chromogenic material and the developer discriminately occurs in the exposed or unexposed areas and produces a detectable or latent image. This is accomplished image-wise by photochemically controlling the access between the chromogenic material and the developer such that a patterned reaction occurs. By "imagewise" it is meant that the reaction between the chromogenic material and the developer occur according to the exposure such that a positive or negative image is obtained. The image may be formed by a change in color or a difference in contrast.

In accordance with the principal embodiment of U.S. Pat. No. 4,440,846, chromogenic material is encapsulated with the photosensitive composition. In general, the photosensitive composition can be described as having a viscosity which changes upon exposure to actinic radiation such that upon exposure there is a change in the viscosity of the internal phase in the exposed areas which image-wise determines whether the chromogenic material is accessible to the developer. The photosensitive composition may be a radiation curable composition which, upon exposure to light, increases in viscosity and immobilizes the chromogenic material, thereby preventing it from reacting with the developer material entirely or in proportion to the tonal depth of the image in the exposed areas. (The term "curable" as used in U.S. Pat. No. 4,440,846 is not limited to materials which are cross-linked, but is open to materials which are simply polymerized.) In another case, the chromogenic material may be encapsulated with a substance which is depolymerized or otherwise decreased in molecular weight upon exposure, resulting in a decrease in molecular weight upon exposure, resulting in a decrease in viscosity which renders the chromogenic material mobile and accessible to the developer in the exposed areas upon capsule rupture.

The imaging system described in U.S. Pat. No. 4,440,846 is potentially useful for producing high quality images, competitive in some cases to those produced with silver-based photographic materials.

Prior patents disclose a wide variety of developer compositions for use in developing a visible image from colorless chromogenic materials, some of which are the following:

U.S. Pat. No. 3,864,146 of Oda, discloses a sheet of record material which is sensitized with a coating to produce color on contact with colorless chromogenic compounds. Such coating comprises a binder in an amount sufficient to adhere the coating to the base sheet and a color reactant material. The color material essentially comprises in combination:

a. At least one metal ion of a metal selected from the group consisting of zinc, aluminum, calcium, magnesium, titanium, nickel, cobalt, manganese, iron, tin, chromium, copper and vanadium, or at least one water insoluble inorganic compound of a metal selected from said metal group, and b. At least one aromatic carboxylic acid derivative including as its major functional arrangement the molecular structure represented by any of the following formulae:

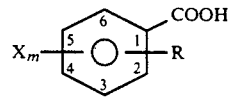

and

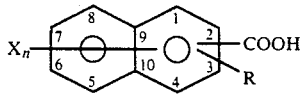

In the above formulae, R is hydroxyl, amino, amino substituted by at least one lower alkyl group having 1 to 5 carbon atoms, nitro or chlorine, which is substituted on one of the carbon atoms at the site adjacent to that of the carboxylic group on the aromatic ring, each X is substituted or unsubstituted group containing a monocyclic or bicyclic carbon ring formed with 6 or 10 carbon atoms, m is an integer of 1 or 2 and n is an integer of 1 to 3.

Among the aromatic carboxylic acid derivatives represented in the above formulae the patent lists the following specific compounds:

3-phenylsalicylic acid
2-chloro-5-phenylbenzoic acid
3-benzylsalicylic acid
5-(4'-hydroxyphenyl)salicylic acid
2-nitro-3(2'-nitro-3'-carboxyphenyl)benzoic acid
5,5'-methylenedisalicylic acid
2-nitro-3(3'-carboxylbenzyl)benzoic acid
3-methyl-5-phenylsalicylic acid
3-(4'-aminophenyl)-2-aminosalicylic acid
5-benzyl-6-aminosalicylic acid
3-methyl-5-benzylsalicylic acid
2,6-dihydroxy-3-(β-phenethyl)benzoic acid
2-nitro-5-(4'-methoxystilben)benzoic acid
2-nitro-6-(4'-methylbenzoyl)benzoic acid
3-(4'-chlorobenzyl)5-(tert-butyl)salicylic acid
3-benzyl-5-(2,2'-dimethyl-iso-propyl)salicylic acid
3-(tert-butyl)-5-[p-(tert-butyl)benzyl]salicylic acid
3-cyclohexyl-5-(α,α-dimethylbenzyl)salicylic acid
4-phenyl-5-benzoylsalicylic acid
3,5-di-(α,α-dimethylbenzyl)salicylic acid 3-[4'-(α,α-dimethylbenzyl)-phenyl]-5-(α,α-dimethylbenzyl)salicylic acid
2-nitro-3-[4'-(α,α-dimethylbenzyl)-phenyl] benzoic acid
3-phenyl-5-[4'-(α,α-dimethylbenzyl)-α,α-dimethylbenzyl]salicylic acid
5-(4'-ethoxycarbonylphenyl)salicylic acid
4-(3'-carboxy-4'-hydroxyphenyl)benzenesulfonic acid
3-phenyl-5-(α,α-dimethylbenzyl)salicylic acid
3-phenyl-5-hydroxysalicylic acid
4-(5'-methylnaphthyl) salicylic acid
2-hydroxy-1-benzyl-3-naphthoic acid
3,3'-dicarboxy-2,2'-dihydroxy-1,1-dinaphthylmethane
1-benzoyl-2-hydroxy-3-naphthoic acid
1-chloro-4'-hydroxy-dinaphthylketone-3'-carboxylic acid
1,4-di(dimethylamino)-3-phenyl-2-naphthoic acid
2-hydroxy-5-[4'-(tert-butyl)phenyl]-1-naphthoic acid
3-hydroxy-5-cyclohexyl-2-naphthoic acid
3-hydroxy-4-(2'-hydroxy-3'-carboxyphenyl) 2-naphthoic acid.

Of the above compounds, 3,5-di(α,α-dimethylbenzyl)salicylic acid, 3-[4'(α,α-dimethylbenzyl)-phenyl-5-(α,α-dimethylbenzyl)salicylic acid, 3-cyclohexyl-5-(α,α-dimethylbenzyl)salicylic acid, 3-phenyl-5-[4'-(α,α-dimethylbenzyl)-α,α-dimethylbenzyl]salicylic acid, and 3-phenyl-5-(α,α-dimethylbenzyl)salicylic acid are said to be most preferred.

According to U.S. Pat. No. 3,864,146, it was found that the aforementioned aromatic carboxylic acid derivatives, per se, do not provide practical color-forming reactant materials because of their very slight activity to the colorless chromogenic materials but they can be highly sensitive color-forming reactant materials when they are combined with certain metal ions or certain water-insoluble inorganic metallic compounds. In a preferred embodiment of the invention, the color reactant material essentially comprises a mixture of the aromatic carboxylic acid derivatives described and one or more of oxides, hydroxides and carbonates of a metal selected from the group consisting of zinc, aluminum, calcium, magnesium, titanium, nickel, cobalt, manganese, iron, tin, chromium, copper and vanadium. Among suitable inorganic metallic compounds there may be included zinc oxide, aluminum oxide, calcium oxide, magnesium oxide, titanium oxide, zinc hydroxide, aluminum hydroxide, calcium hydroxide, zinc carbonate, calcium carbonate and magnesium hydroxide. These inorganic metallic compounds are water insoluble, per se, and exhibit no substantially color forming reaction even when brought into contact with the chromagenic materials. According to U.S. Pat. No. 3,864,146, the mixing ratio by weight of the aromatic carboxylic acid derivative or derivatives to the above mentioned inorganic metallic compound or compounds is selected within the range of 95:5 to 5:95. More preferably, in order to obtain the sensitized record sheet having a high color forming ability, high printability and a low production cost, 15 to 25 parts by weight of the aromatic carboxylic acid derivative may be mixed with 85 to 75 parts by weight of the inorganic compound described. A part of the inorganic metallic compound may be replaced by other inorganic pigments such as kaolin, clay and talc.

U.S. Pat. No. 3,723,156 relates to record material sheets bearing a coating of an oil-soluble metal salt and an oil-soluble phenol-formaldehyde novolak resin as a combination co-reactant for colorless, chromogenic dye-precursor materials to develop a useful color therein. Prior to this patent, oil-soluble phenol-formaldehyde novolak resins, preferably those derived from the condensation of a para-substituted phenol with formaldehyde, had long been used, with great commercial success, in making acid-reactant record material sheets capable of developing color in oil solutions of base-reactant colorless, chromogenic dye-precursor materials. Such resins and the use of them had been disclosed in U.S. patent application Ser. No. 44,805, filed June 9, 1970 by Robert E. Miller and Paul S. Phillips, Jr. (now U.S. Pat. No. 3,672,935 and U.S. patent application Ser. No. 830,921, filed May 26, 1969 by Robert E. Miller and Bruce W. Brockett (now U.S. Pat. No. 3,663,256).

According to U.S. Pat. No. 3,723,156, it had been found useful to add metal salts to oil-soluble phenol-formaldehyde resin for the purposes just mentioned. The metal salts found useful for use with oil-soluble phenol-formaldehyde resins in pressure-sensitive copy-papers of the "NCR Paper" type according to that patent, include the oil-soluble salts of aluminum (III), barium (II), cadmium (II), calcium (II), cerium (III), cesium (I), cobalt (II), copper (III), indium (III), iron (II), and lead (II), magnesium (II), manganese (II), molybdenum (V), nickel (II), sodium (I), strontium (II), tin (II), titanium (IV), vanadium (IV), zinc (II), and zirconium (IV). The great diversity of the oil-soluble metal resinates tested and found useful therein was noted inasmuch as they include metals from Periodic Groups I-A and B, II-A and B, III-A and B, IV-A and B, V-B, VI-B, VII-B, and VIII.

Eligible ions of the useful metal salts according to U.S. Pat. No. 3,723,156 include acetylacetonate, hexafluoroacetylacetonate, benzoate, naphthenate, salicylate, 2-ethylhexanoate, abietate, oleate, and palmitate. In order to be eligible, it was said that the candidate anion should confer on the metal salt ready solubility in the oily solvents used as the core-material encapsulated chromogenic inks in carbonless copypapers. Exemplary of the oils in use are hydrocarbons such as paraffin oils, aromatic oils such as xylene and alkylated biphenyls, high molecular weight esters such as dioctyl adipate and dioctyl phthalate, halocarbons such as trichlorobiphenyl, and aromatic ethers such as diphenyl oxide. The metal modified resins of U.S. Pat. No. 3,723,156 were said to have been designed to operate and to have operated well in developing oily dye-precursor inks of the type described. The oily vehicle preferred therein was one of low volatility, such as chlorinated or alkylated biphenyl, which leaves an essentially wet print on the paper surface rather than a more volatile one such as xylene that readily evaporates to leave a dry print. The enhancement of print intensity by the metal modified resins of this invention was said to be considerably greater in wet prints than in dry prints. Rapid and substantial solubility was required to give satisfactory print speed in use. To fulfill this requirement, according to the patent, the metal salt anion should have a carbon content of at least four carbon atoms and preferably six or more carbon atoms. Metal salts of anions of less than four carbon atoms will operate to enhance color intensity and/or fade resistance provided they are still oil-soluble. However, as the anionic carbon content goes below about four carbon atoms, the metal salts tend toward water solubility, and the imaged prints developed thereon become spotty and uneven due to the effect of atmospheric moisture on stored sheets. Therefore it was said that metal salts of carbon content below about four carbon atoms, which are both oil-soluble and water soluble, were to be avoided in the record material sheets.

Of the metal ions set out above as having been found useful in the materials of U.S. Pat. No. 3,723,156, zinc (II) was preferred. All of the cited metal ions were said to improve the fade resistance of the developed prints. In addition to improved fade resistance, print intensity was markedly improved over known-art sheets by the preferred zinc (II) and furthermore, print intensity was improved or at least comparable to good commercial quality known-art sheets in sheets containing aluminum (III), cerium (III), cobalt (II), iron (II), iron (III), indium (III), manganese (II), and tin (II).

The patent also mentioned that zinc salicylate, which has a phenolic group in addition to the metallated carboxy group, gives a blue color with CVL in oil solution. Oil solutions of some of the other eligible metal salts occasionally give a light blue color when CVL is added to the solution, but this was thought to be due to excess acid present as a contaminant in the metal salt.

U.S. Pat. No. 4,372,583 discloses a pressure-sensitive chromogenic copy system comprising a transfer sheet having on at least one surface thereof a color developer capable of reacting with a chromogen to form a color image, said color developer comprising an oligomeric aromatic carboxylic acid. The patent also relates to transfer sheets utilizing said oligomeric compounds and to the compounds and method of making them as more fully described below.

The critical feature described in U.S. Pat. No. 4,372,583 is the controlled reaction of aromatic carboxylic acids with aldehydes under alkaline conditions to form "oligomers". While not entirely understood, the reaction products are similar to resoles; A-stage resoles or salicylate alcohols, formed by reacting a phenol with an aldehyde under alkaline conditions. As used in that patent, the term "oligomer" is meant to denote such reaction products as distinguished from dimers and polymers which result when aromatic carboxylic acids are polymerized under acidic conditions.

According to U.S. Pat. No. 4,372,583, higher molecular weight polymers can result in low oil affinity and hence undesirable slower image formation when the chromogen-containing oil from the ruptured microcapsules is transferred to the transfer sheet containing the acidic polymer.

The aromatic carboxylic acid used by that patent can be any polymerizable substituted or unsubstituted salicylic, benzoic, or naphthoic acid. It was preferred to use compounds which do not contain substituents of a size or location on the compound so as to create steric hindrances and thereby retard or even prevent polymerization. Examples of suitable acids are salicylic acid; acetyl salicylic acid; disalicylic acid; mono-and di-$C_1$–$C_8$ alkyl substituted salicylic acids (such as methyl salicylic acid and 3,5-di-tertiary butyl salicylic acid); the corresponding benzoic and naphthoic acids; 2-nitro benzoic acid; 2-amino naphthoic acid; and the thio compounds disclosed in co-pending U.S. patent application Ser. No. 173,254, entitled "Chromogenic Copy System", filed on Aug. 17, 1981, now U.S. Pat. No. 4,303,719. Of these, the patent preferred the salicylic acid compounds; particularly salicylic acid, 3,5-di-tertiary butyl salicylic acid, 3-octyl salicylic acid, 5-octyl salicylic acid, 3-tertiary butyl salicylic acid, and 5-tertiary butyl salicylic acid and the invention will be particularly described in connection therewith.

According to U.S. Pat. No. 4,372,583, the resultant oligomer can be used as such or as the corresponding metal salts. These are formed by reacting the acidic oligomer with zinc, aluminum, monovalent alkali metal compounds, or other known metallic compounds conventionally used to form salts of acids used as color developers in carbonless copy systems.

U.S. Pat. No. 3,772,052 discloses a color developer that is the metal compound of a polymer of an aldehyde or acetylene and an aromatic carboxylic acid having at least one hydroxyl group which is a product produced by the reaction of an alkali metal salt of the polymer of an aldehyde or acetylene and an aromatic carboxylic acid having at least one hydroxyl group with a water-soluble metal salt in a solvent in which both reagents are soluble. In this case, the ratio of the alkali metal salt and water-soluble metal salt is not limited particularly, but a molar ratio of 1 to 1 is preferred. Preparation of the alkali metal salt of the polymer used in the above-mentioned reaction can be carried out in a known manner, for example, by reacting the abovementioned polymer with an alkali metal hydroxide or carbonate.

Illustrative of the polymer of an aldehyde and an aromatic carboxylic acid having at least one hydroxyl group used in U.S. Pat. No. 3,772,052 are a salicylic acid-aldehyde polymer, a p-hydroxybenzoic acid-aldehyde polymer, a 2,6-dihydroxybenzoic acid-aldehyde polymer and a salicylic acid-acetylene polymer.

The polymer applicable to U.S. Pat. No. 3,772,052 is a polymer of an aldehyde and an aromatic carboxylic acid having at least one hydroxyl group, while metal compounds of phenol-aldehyde polymers mentioned in Japanese Patent No. 511,757, phenol-acetylene polymers, maleic acid-rosin resins and partly or extensively hydrolyzed styrene-maleic anhydride polymers were said to have no developing capacity.

The aromatic carboxylic acid used in U.S. Pat. No. 3,772,052 is a compound having at least one carboxyl group per aromatic nucleus and includes, for example, benzoic acid, o-nitrobenzoic acid, m-nitrobenzoic acid, p-nitrobenzoic acid, o-chlorobenzoic acid, m-chlorobenzoic acid, p-chlorobenzoic acid, o-toluic acid, m-toluic acid, p-toluic acid, o-bromobenzoic acid, m-bromobenzoic acid, p-bromobenzoic acid, o-indobenzoic acid, m-iodobenzoic acid, p-iodobenzoic acid, 4-methyl-3-nitrobenzoic acid, 2-chloro-4-nitrobenzoic acid, 2,3-dichlorobenzoic acid, 2,4-dichlorobenzoic acid, p-isopropyl-benzoic acid, 2,5-dinitrobenzoic acid, 3,4-dinitrobenzoic acid, 3,5-dinitrobenzoic acid, p-tert-butylbenzoic acid, N-phenyl-anthranilic acid, 4-methyl-3-nitrobenzoic acid, 4-acetyl-benzoic acid, salicylic acid, 5-tert-butyl-salicylic acid, 3-phenyl-salicylic acid, 3-methyl-5-tert-butylsalicylic acid, 3,5-di-tert-butyl-salicylic acid, 3,5-di-tert-amyl-salicylic acid, 3-cyclohexyl-salicylic acid, 3-methyl-5-isoamyl-salicylic acid, 5-isoamyl-salicylic acid, 3,5-di-sec-butyl-salicylic acid, m-hydroxyl-benzoic acid, p-hydroxybenzoic acid, 3,5-dinitrosalicylic acid, p-hydroxybenzoic acid, 3,5-dinitrosalicylic acid, 2-hydroxy-3-methylbenzoic acid, 2,4-cresotinic acid, 2,5-cresotinic acid, 2,3-cresotinic acid, 2,4-dihydroxy-benzoic acid, 2,5-dihydroxybenzoic acid, 2,6-dihydroxybenzoic acid, 1-naphthoic acid, 2-naphthoic acid, 1-hydroxy-2-naphthoic acid, 2-hydroxy-3-naphthoic acid, 2-hydroxyl-1-naphthoic acid, 5,5'-methylenesalicyclic acid, thiosalicylic acid, trimellitic anhydride, anacardic acid, benzoic anhydride, 2-carboxybenzaldehyde, diphenic acid, etc. Above all, aromatic carboxylic acids having at least one hydroxyl group in the structure are effective.

Illustrative of the metal salts used in U.S. Pat. No. 3,772,052 are metals of Group Ib of the Periodic Table such as copper and silver, Group IIa such as magnesium and calcium, Group IIb such as zinc, cadmium and mercury, Group IIb such as aluminum and gallium, Group IVa such as tin and lead, Group IVb such as chromium and molybdenum, Group VIIb such as manganese and Group VII such as cobalt and nickel. In particular, salts of zinc, tin, aluminum and nickel are preferably used.

U.S. Pat. No. 3,874,895 discloses using a color developer containing, as necessary constituents, an acidic polymer and an organic carboxylic acid or a metal salt thereof.

The organic carboxylic acids used in that patent include organic compounds having at least one carboxyl group, and include aliphatic carboxylic acids and aromatic carboxylic acids. Most preferred of such acids were those having a maximum of three carboxyl groups and from about 5 to about 20 carbon atoms.

However, aromatic carboxylic acids were especially preferred as they were said to provide excellent effects and, in particular, aromatic carboxylic acids having at least one hydroxy group were preferred with those having from one to three hydroxyl groups being most preferred. Of course, any organic carboxylic acid exhibits an improved effect as compared to the use of acidic polymer alone, and aliphatic carboxylic acids or metal salts thereof, in particular, the monobasic acids and dibasic acids thereof were said to be excellent from the viewpoint of film quality. Monobasic acids were most preferred, however. The aromatic carboxylic acid was preferably from the benzene series, especially salicylic acid derivatives which preferably have at least one alkyl group having more than 3 carbon atoms, or at least one aryl group or a cyclohexyl group, or is substituted with a combination of such groups.

As the specific examples of organic carboxylic acids used in U.S. Pat. No. 3,874,895, there were mentioned formic acid, acetic acid, caproic acid, heptanoic acid, caprylic acid, pelargonic acid, capric acid, n-undecylenic acid, lauric acid, n-dodecylenic acid, myristylenic acid, n-pentadecylenic acid, margaric acid, stearic acid, n-non-adecylenic acid, arachidic acid, heneicosanoic acid, behenic acid, n-tricosanoic acid, lignoceric acid, n-pentacosanoic acid, cerotic acid, n-heptacosanoic acid, montanic acid, n-nonacousanoic acid, melissic acid, n-hentriacontanoic acid, n-dotriacontaonic acid, n-tetratriacontanoic acid, ceroplastic acid, n-hexatoriacontanoic acid, n-octatriacontanoic acid, n-hexatetracontanoic acid, oleic acid, linolenic acid, linoleic acid, stearolic acid, α-chlorolauric acid, α-chlorostearic acid, α-bromomyristic acid, 1,8-octanedicarboxylic acid, 1,12-dodecanedicarboxylic acid, 2,4-decanedienoic acid, 2-hydroxy-2,4-dimethylpentanoic acid, o-toluic acid, m-toluic acid, p-toluic acid, benzoic acid, o-chlorobenzoic acid, m-chlorobenzoic acid, p-chlorobenzoic acid, o-bromobenzoic acid, p-nitrobenzoic acid, salicylic acid, o-chlorosalicylic acid, m-hydroxysalicylic acid, p-hydroxysalicylic acid, anisic acid, gallic acid, phthalic acid, trimellitic acid, diphenic acid, phenylacetic acid, α-phenyl-n-valerianic acid, p-isopropylbenzoic acid, 2,4-cresotinic acid, 5-methylsalicylic acid, 5-tert-butylsalicylic acid, 3,5-di-sec-butylsalicylic acid, 3,5-di-sec-butylsalicylic acid, 3,-methyl-5-tert-butylsalicylic acid, 3,5-di-tert-butylsalicylic acid, 5-isoamylsalicylic acid, 3-phenylsalicylic acid, 5-cyclohexylsalicylic acid, and the like.

According to U.S. Pat. No. 3,874,895, metals forming a metal salt with the organic carboxylic acids included sodium, lithium, potassium, magnesium, calcium, zinc, cadmium, aluminum, tin, lead, chromium, manganese, cobalt, nickel, and the like. The patent stated that there is no overly critical aspect to the selection of the exact metal used, i.e., substantially all metal salts are useful.

U.S. Pat. No. 3,896,255 disclosed that when a coating solution containing a metal compound of aromatic carboxylic acid was prepared, not only was the viscosity of the coating solution increased but metal compound was formed in the form of particles, so that the color development power and the film surface strength of the final color developer layer were often insufficient, and that improvements can be attained by incorporating a surface active agent in a color developer coating solution containing a metal component of an aromatic carboxylic acid.

U.S. Pat. No. 3,896,255 further disclosed that, while the metal compound of an aromatic carboxylic acid can be used as a color developing component alone because it has a color development power itself, it can also be used together with other color developers.

The aromatic carboxylic acid of U.S. Pat. No. 3,896,255 was preferably represented by the formula:

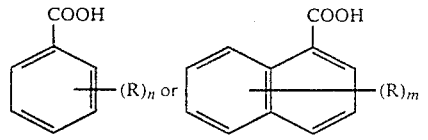

wherein R may be the same or different and represents a hydrogen atom, a hydroxy group, a halogen atom such as chlorine, a nitro group, an alkyl group having 1 to 10 carbon atoms (preferably 3 to 6 carbon atoms) of which total carbon atoms are less than 13, an aryl group such as phenyl group, an arylamino group such as anilino group, and an alicyclic group such as hexyl group, m is an integer of 0 to 7 and n is an integer of 0 to 5, and the aromatic carboxylic acid may be dimerized through the substituent R as a methylene group.

More preferable compounds were those represented by the formula:

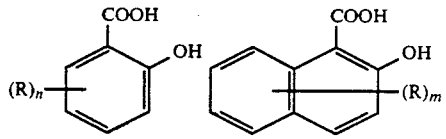

wherein R, m and n are as defined above.

The most preferable compounds were those represented by the formula:

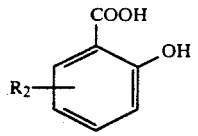

wherein R is as defined above, n is 1 or 2, and R is attached to the meta-position relative to the hydroxy group.

Examples of the aromatic carboxylic acids in U.S. Pat. No. 3,896,255 were benzoic acid, o-, m- or p-chlorobenzoic acid, o-, m- or p-nitrobenzoic acid, 2-chloro-4-nitrobenzoic acid, 2,3-dichlorobenzoic acid, 2,4-dichlorobenzoic acid, p-t-butyl benzoic acid, N-phenyl anthranilic acid, 4-methyl-3-nitrobenzoic acid, salicylic acid, m-hydroxybenzoic acid, p-hydroxybenzoic acid, 3,5-dinitrosalicylic acid, 5-t-butyl salicylic acid, 3-phenylsalicylic acid, 3-methyl-5-butyl salicylic acid, 3,5-di-t-butyl salicylic acid, 3,5-diamyl salicylic acid, 3-cyclohexyl salicylic acid, 5-cyclohexyl salicylic acid, 3-methyl-5-isoamyl salicylic acid, 5-isoamyl salicylic acid, 3,5-di-sec-butyl salicylic acid, 5-nonyl salicylic acid, 2-hydroxy-3-methyl benzoic acid, 2-hydroxy-5-t-butyl benzoic acid, 2,4-cresotic acid, 5,5'-methylene disalicylic acid, o-, m- or p-acetaminobenzoic acid, 2,4-dihydroxy benzoic acid, 2,5-dihydroxy benzoic acid, 2,6-dihydroxy benzoic acid, anacardic acid, 1-naphthoic acid, 2-naphthoic acid, 1-hydroxy-2-naphthoic acid, 2-hydroxy-3-naphthoic acid, 2-hydroxy-1-naphthoic acid, thiosalicylic acid, 2-carboxybenzaldehyde and the like.

Above all, aromatic carboxylic acids having at least one hydroxyl group were said to be especially effective and those having a hydroxy group in the o-position, i.e., the aromatic carboxylic acids represented by the following formulae, were most effective.

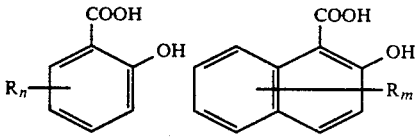

wherein R, m and n are as defined above.

As the metals which form the metal compound of the aromatic carboxylic acid used in U.S. Pat. No. 3,896,255, there can be mentioned metals of Group IB of the Periodic Table as, e.g., copper and silver; metals of Group II A as, e.g., magnesium and calcium; metals of Group II B, e.g., zinc, cadmium and mercury; metals of Group III B, e.g., aluminum and gallium; metals of Group IV A, e.g., tin and lead; metals of Group VI A, e.g., chromium and molybdenum; metals of Group VII B, e.g., manganese; and metals of Group VIII such as cobalt and nickel. Among these metals, zinc, tin, aluminum and nickel were said to be especially effective.

U.S. Pat. No. 3,924,027 discloses a sensitized sheet for use in a pressure sensitive copy system, having a coating comprising an acceptor, the acceptor being a particulate mixture of (a) an organic acid substance selected from the group consisting of aromatic carboxylic acids and polyvalent metal salts thereof, and (b) an organic high molecular weight compound.

An aromatic carboxylic acid to be used for this purpose is represented by the formula I,

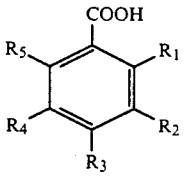

I wherein $R_1$, $R_2$, $R_3$ and $R_4$ each represents hydrogen, halogen or a hydroxyl, amino, carboxyl, carbamoyl, N-substituted carbamoyl, alkyl, cycloalkyl, alkoxyl, aryloxy, aralkyl or alkylaryl group, and any adjacent pair or $R_1$ to $R_6$ can, together with the carbon atoms to which they are attached, complete a ring. Compounds of formula I wherein $R_1$ or $R_5$ is a hydroxyl group are especially important in embodiments of the invention as mentioned in detail hereinafter.

Examples of aromatic carboxylic acids of formula I wherein $R_1$ and $R_6$ are not a hydroxyl group include benzoic acid, o-toluic acid, m-toluic acid, p-toluic acid, p-t-butylbenzoic acid, o-chlorobenzoic acid, m-chlorobenzoic acid, p-chlorobenzoic acid, dichlorobenzoic acid, trichlorobenzoic acid, tetrachlorobenzoic acid, phthalic acid, isophthalic acid, terephthalic acid, 2-carboxybiphenol, p-oxybenzoic acid, paramethoxybenzoic acid, p-butoxybenzoic acid, p-octoxybenzoic acid, gallic acid, anthranilic acid, phthalic acid monoamide, phthalic acid monoanilide, 3-tert-butyl-4-hydroxybenzoic acid, 3-cyclohexyl-4-hydroxybenzoic acid, 3-phenyl-4-hydroxybenzoic acid, 3-(α-methylbenzyl)-4-hydroxybenzoic acid, 3,5-dimethyl-4-hydroxybenzoic acid, trimellitic acid, pyromellitic acid, α-naphthoic acid, β-naphthoic acid, tetrachlorophthalic acid and 2,2'-dicarboxydiphenyl.

Aromatic carboxylic acids of formula I wherein $R_1$ or $R_6$ is a hydroxyl group are defined by formula II,

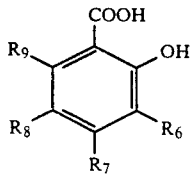

II wherein $R_4$ to $R_6$ are as defined in $R_1$ to $R_4$ of formula I.

Examples of such carboxylic acids include salicylic acid, o-cresotinic acid, p-cresotinic acid, 3-ethylsalicylic acid, 4-ethylsalicylic acid, 3-isopropylsalicylic acid, 4-isopropylsalicylic acid, 5-isopropylsalicylic acid, 3-tert-butylsalicylic acid, 5-tert-butylsalicylic acid, 3-cyclohexylsalicylic acid, 5-cyclohexylsalicylic acid, 3-phenylsalicylic acid, 5-phenylsalicylic acid, 3-benzylsalicylic acid, 5-tert-octylsalicylic acid, 3-(α-methylbenzyl) salicylic acid, 5-(α-methylbenzyl) salicylic acid, 5-nonyl salicylic acid, 5-(α,α-dimethylbenzyl) salicylic acid, 5-chlorosalicylic acid, 5-butoxysalicylic acid and 5-octoxysalicylic acid.

Compounds of formula II wherein $R_4$ and $R_6$ are halogen, alkyl, cycloalkyl, aryl, aralkyl or alkylaryl can be easily derived in commercial scales from phenols, alkylphenols, arylphenols or halogenated phenols. Examples of such aromatic carboxylic acids include 3,5-dichlorosalicylic acid, 3-chloro-5-tert-butylsalicylic acid, 3-chloro-5-tertamylsalicylic acid, 3-chloro-5-tert-octylsalicylic acid, 3-chloro-5-(α,α-dimethylbenzyl) salicylic acid, 3,5-dimethylsalicylic acid, 3-methyl-5-tertbutylsalicylic acid, 3-methyl-5-cyclohexylsalicylic acid, 3-methyl-5-tert-octylsalicylic acid, 3-methyl-5-(α-methylbenzyl) salicylic acid, 3-methyl-5-nonylsalicylic acid, 3-methyl-5-(α,α-dimethylbenzyl salicylic acid, 3,5-diisopropylsalicylic acid, 3,5-di-sec-butylsalicylic acid, 3-tert-butyl-5-chlorosalicylic acid, 3-tert-butyl-5-methylsalicylic acid, 3-tert-butyl-5-ethylsalicylic acid, 3,5-di-tert-butylsalicylic acid, 3-tert-butyl-5-phenylsalicylic acid, 3-tert-butyl-5-(4'-tert-butylphenyl)salicylic acid and others.

U.S. Pat. No. 3,934,070 claims to have found that all defects of the color developer sheet and ink can be completely removed by using a metallic compound of an aromatic carboxylic acid.

The aromatic carboxylic acid used in that patent includes, for example, benzoic acid, o-nitrobenzoic acid, m-nitrobenzoic acid, p-nitrobenzoic acid, o-chlorobenzoic acid, m-chlorobenzoic acid, p-chlorobenzoic acid, o-toluic acid, m-toluic acid, p-toluic acid, o-bromobenzoic acid, m-bromobenzoic acid, p-bromobenzoic acid, o-iodo-benzoic acid, m-iodobenzoic acid, p-iodobenzoic acid, 4-methyl-3-nitrobenzoic acid, 2-chloro-4-nitrobenzoic acid, 2,3-dichlorobenzoic acid, 2,4-dichlorobenzoic acid, p-isopropyl-benzoic acid, 2,5-dinitrobenzoic acid, 3,4-dinitrobenzoic acid, 3,5-dinitrobenzoic acid, p-tert-butylbenzoic acid, N-phenyl-anthranilic acid, 4-methyl-3-nitrobenzoic acid, 4-acetyl-benzoic acid, salicylic acid, 5-tert-butylsalicylic acid, 3-phenyl-salicylic acid, 3-methyl-5-tert-butyl-salicylic acid, 3-phenyl-salicyclic acid, 3-methyl-5-tert-butyl-salicylic acid, 3,5-di-tert-butyl-salicylic acid, 3,5-dihydroxybenzoic acid, 1-naphthoic acid, 2-naphthoic acid, 1-hydroxy-2-naphthoic acid, 2-hydroxy-3-naphthoic acid, 2-hydroxy-1-naphthoic acid, 5,5'-methylene-salicyclic acid, thiosalicylic acid, trimellitic anhydride, anacardic acid, benzoic anhydride, 2-carboxybenzaldehyde, diphenic acid, etc. Above all, aromatic carboxylic acids having at least one hydroxyl group in the structure, especially in the ortho positon, were said to be effective.

The metals of the metal salts to be reacted with the alkali metal salts of the carboxylic acids in U.S. Pat. No. 3,934,070 included, for example, Group Ib metals such as copper, silver, etc., Group IIa metals such as magnesium, calcium, etc., Group IIb metals such as zinc, cadmium, mercury, etc., Group IIIb metals such as aluminum, gallium, etc., Group IVb metals such as tin, lead, etc., Group VIa metals such as chromium, molybdenum, etc., Group VIIa metals such as manganese, etc., Group VIII metals such as cobalt, nickel, etc., and the like. Among these, those salts wherein zinc, tin, aluminum or nickel is used are especially effective. In using them in the reaction, they are used in the form of the inorganic salts thereof such as chloride, sulfate, nitrate, etc., or in the form of the organic salts thereof such as oxalate, acetate, etc. These metal salts or alkali metal salts of the aromatic carboxylic acid exhibit almost no colordeveloping ability when used separately, but when their reaction product is coated onto a support, the metal salts of the carboxylic acids show excellent color developing ability.

U.S. Pat. No. 4,134,847 discloses a color developer which is obtained by the process which comprises heating a mixture of at least one aromatic carboxylic acid, at least one water-insoluble organic polymer and at least one oxide or carbonate of a polyvalent metal in the presence of water to melt at least one of aromatic carboxylic acid and said polymer and to make the mixture into a homogeneous mass.

The organic carboxylic acid useful in that patent is represented by the following formula I except for the compounds having a heteroaromatic ring.

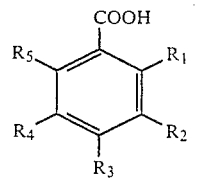

(I)

wherein $R_1$, $R_2$, $R_3$, $R_4$ and $R_5$ each represents hydrogen, halogen or a hydroxyl, amino, carboxyl, carbamoyl, N-substituted carbamoyl, alkyl, cycloalkyl, alkoxyl, aryl, aryloxy, aralkyl or alkylaryl group, and any adjacent pair of $R_1$ to $R_5$ can complete a ring such as naphthalene ring. Compounds of formula I wherein $R_1$ or $R_5$ is a hydroxyl group are especially important in embodiments of the invention as mentioned in detail hereinafter.

Examples of aromatic carboxylic acids of formula I wherein $R_1$ and $R_5$ are not a hydroxyl group include benzoic acid, o-toluic acid, m-toluic acid, p-toluic acid, p-tert-butylbenzoic acid, o-chlorobenzoic acid, m-chlorobenzoic acid, p-chlorobenzoic acid, dichlorobenzoic acid, trichlorobenzoic acid, phthalic acid, isophthalic acid, terephthalic acid, p-oxybenzoic acid, p-butoxybenzoic acid, p-octoxybenzoic acid, gallic acid, anthranilic acid, phthalic acid monoamide, 3-tert-butyl-t-hydroxybenzoic acid, 3-cyclohexyl-4-hydroxybenzoic acid, 3-phenyl-4-hydroxybenzoic acid, 3-(α-methylbenzyl)-4-hydroxybenzoic acid, 3,5-dimethyl-4-hydroxybenzoic acid, trimellitic acid, pyromellitic acid, α-naphthoic acid, β-naphthoic acid, tetrachlorophthalic acid, 2-carboxybiphenyl and 2,2'-dicarboxydiphenyl.

Aromatic carboxylic acids of formula I wherein $R_1$ or $R_5$ is a hydroxyl group are defined by formula II,

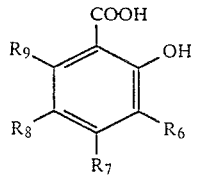

(II)

wherein $R_6$ to $R_9$ are as defined in $R_1$ to $R_5$ of formula I.

Examples of such carboxylic acids include salicylic acid, o-cresotinic acid, p-cresotinic acid, 3-ethylsalicylic acid, 4-ethylsalicylic acid, 3-isopropylsalicylic acid, 4-isopropylsalicylic acid, 5-isopropylsalicylic acid, 3-tert-butylsalicylic acid, 5-tert-butylsalicylic acid, 3-cyclohexylsalicylic acid, 5-cyclohexylsalicylic acid, 3-phenylsalicylic acid, 5-phenylsalicylic acid, 3-benzylsalicylic acid, 5-tert-octylsalicylic acid, 3-(α-methylbenzyl) salicylic acid, 5-(α-methylbenzyl) salicylic acid, 5-nonylsalicylic acid, 5-(α,α-dimethylbenzyl) salicylic acid, 5-chlorosalicylic acid, 5-butoxysalicylic acid and 5-octoxysalicylic acid.

Compounds of formula II wherein $R_6$ and $R_8$ are halogen, alkyl, cycloalkyl, aryl, aralkyl or alkylaryl can be easily derived in commercial scales from phenols, alkylphenols, arylphenols or halogenated phenols. Examples of such aromatic carboxylic acids, include 3,5-dichlorosalicylic acid, 3-chloro-5-tert-butylsalicylic acid, 3-chloro-5-tert-amylsalicylic acid, 3-chloro-5-tert-octylsalicylic acid, 3-chloro-5-(α,α-dimethylbenzyl) salicylic acid, 3,5-dimethylsalicylic acid, 3-methyl-5-tert-butylsalicylic acid, 3-methyl-5-cyclohexylsalicylic acid, 3-methyl-5-tert-octylsalicylic acid, 3-methyl-5-(α-methyl-benzyl) salicylic acid, 3-methyl-5-nonylsalicylic acid, 3-methyl-5-(α,α-dimethylbenzyl) salicylic acid, 3,5-diisopropylsalicylic acid, 3,5-sec-butylsalicylic acid, 3-tert-butyl-5-chlorosalicylic acid, 3-tert-butyl-5-methylsalicylic acid, 3-tert-butyl-5-ethylsalicylic acid, 3,5-di-tert-butylsalicylic acid, 3-tert-butyl-5-cyclohexylsalicylic acid, 3-tert-butyl-5-phenylsalicylic acid, 3-tert-butyl-5-(4'-tert-butylphenyl) salicylic acid, 3-tert-amyl-5-chlorosalicylic acid, 3-tert-amyl-5-methylsalicylic acid, 3-tert-amyl-5-ethylsalicylic acid, 3,5-di-tert-amylsalicylic acid, 3-tert-amyl-5-cyclohexylsalicylic acid, 3-tert-amyl-5-phenylsalicylic acid, 3-tert-amyl-5-(4'-tert-amylphenyl) salicylic acid, 3-cyclohexyl-5-chlorosalicylic acid, 3-cyclohexyl-5-methylsalicylic acid, 3-cyclohexyl-5-ethylsalicylic acid, 3,5-dicyclohexylsalicylic acid, 3-cyclohexyl-5-phenylsalicylic acid, 3-cyclohexyl-5-(4'-cyclohexylphenyl) salicylic acid, 3-phenyl-t-chlorosalicylic acid, 3-phenyl-t-isopropylsalicylic acid, 3-phenyl-5-tert-butylsalicylic acid, 3-phenyl-5-cyclohexylsalicylic acid, 3-phenyl-5-benzylsalicylic acid, 3-phenyl-5-tert-octylsalicylic acid, 3-phenyl-5-(α-methylbenzyl) salicylic acid, 3-phenyl-5-nonylsalicylic acid, 3-phenyl-5-(α,α-dimethylbenzyl) salicylic acid, 3-benzyl-5-chlorosalicylic acid, 3-benzyl-5-methylsalicylic acid, 3-benzyl-5-ethylsalicylic acid, 3-benzyl-5-cyclohexylsalicylic acid, 3-benzyl-5-phenylsalicylic acid, 3,5-dibenzylsalicylic acid, 3-benzyl-5-tert-octylsalicylic acid, 3-benzyl-5-nonylsalicylic acid, 3-benzyl-5-(α,α-dimethylbenzyl) salicylic acid, 3-tert-octyl-5-chlorosalicylic acid, 3-tert-octyl-5-methylsalicylic acid, 3-tert-octyl-5-ethylsalicylic acid, 3-tert-octyl-5-cyclohexylsalicylic acid, 3-tert-octyl-5-phenylsalicylic acid, 3,5-di-tert-octylsalicylic acid, 3-(α-methylbenzyl)-5-chlorosalicylic acid, 3-(α-methylbenzyl)-5-methylsalicylic acid, 3-(α-methylbenzyl)-5-ethylsalicylic acid, 3-(α-methylbenzyl)-5-cylohexylsalicylic acid, 3-(α-methylbenzyl)-5-phenylsalicylic acid, 3,5-di(α-methylbenzyl) salicylic acid, 3-(α-methylbenzyl)-5-(α,αdimethylbenzyl) salicylic acid, 3-(α-methylbenzyl)-5-{4'-(α-methylbenzyl)phenyl} salicylic acid, 3-nonyl-5-chlorosalicylic acid, 3-nonyl-5-methylsalicylic acid, 3-nonyl-5-ethylsalicylic acid, 3-nonyl-5-phenylsalicylic acid, 3,5-dinonylsalicylic acid, 3-(α,α-dimethylbenzyl)-5-chlorosalicylic acid, 3-(α,α-dimethylbenzyl)-5-methylsalicylic acid, 3-(α,α-dimethylbenzyl)-5-ethylsalicylic acid, 3-(α,α-dimethylbenzyl)-5-t-amylsalicylic acid, 3-(α,α-dimethylbenzyl)-5-cyclohexylsalicylic acid, 3(α,α-dimethylbenzyl)-5-phenylsalicylic acid, 3-(α,α-dimethylbenzyl)-5-(α-methylbenzyl) salicylic acid, 3,5-di(α,α-dimethylbenzyl) salicylic acid, 3-(4'-tert-butylphenyl)-5-tert-butylsalicylic acid, 3-(4'-cyclohexylphenyl)-5-cyclohexylsalicylic acid and 3-{4'-(α,α-dimethylbenzyl) phenyl}-5-(α,α-dimethylbenzyl) salicylic acid.

Aromatic carboxylic acids of formula II in which $R_7$ or $R_9$ is alkyl or phenyl can be derived from, for example, metacresol, metapropylphenol, metaphenylphenol, 2,3-xylenol, 2,5-xylenol, 3,4-xylenol and 3,5-xylenol. Examples of such carboxylic acids include 3,4-dimethylsalicylic acid, 4,5-dimethylsalicylic acid, 4,6-dimethylsalicylic acid, 4-methyl-5-isopropylsalicylic acid, 4-methyl-5-sec-butylsalicylic acid, 4-methyl-5-tert-butylsalicylic acid, 4-methyl-5-tert-amylsalicylic acid, 4-methyl-5-cyclohexylsalicylic acid, 4-methyl-5-benzylsalicylic acid, 4-methyl-5-tert-octylsalicylic acid, 4-methyl-5-(α-methylbenzyl) salicylic acid, 4-methyl-5-nonylsalicylic acid, 4-methyl-5-(α,α-dimethylbenzyl) salicylic acid, 3,6-dimethylsalicylic acid, 3-tert-butyl-6-methylsalicylic acid, 3-tert-amyl-6-methylsalicylic acid, 3-cyclohexyl-6-methylsalicylic acid, 3-tert-octyl-6-methylsalicylic acid, 3-(α-methylbenzyl)6-methylsalicylic acid, 3,6-diisopropylsalicylic acid, 3-tert-butyl-6-isopropylsalicylic acid, 3-tert-octyl-6-isopropylsalicylic acid, 3-(α,α-dimethylbenzyl)-6-isopropylsalicylic acid, 3-tert-butyl-6-phenylsalicylic acid, 3-tert-amyl-6-phenylsalicylic acid, 3-cyclohexyl-6-phenylsalicylic acid, 3-tert-octyl-6-phenylsalicylic acid, 3-(α-methylbenzyl)-6-phenylsalicylic acid or 3-(α,α-dimethylbenzyl)-6-phenylsalicylic acid.

Aromatic carboxylic acids derived from, for example, bisphenol A, 4,4'-dihydroxycyclohexylidenebiphenyl, 4,4'-dihydroxymethylenebiphenyl and 2,2'-dihydroxydiphenyloxide are regarded as condensates of salicyclic acid. Examples of these carboxylic acids include 5-(4'-hydroxybenzyl) salicylic acid, 5-(3'-carboxy-4'-hydroxybenzyl) salicylic acid (methylene-bissalicylic acid), 3-tert-butyl-5-(3',5'-di-tert-butyl-4-hydroxybenzyl) salicylic acid, 3-(α,α-dimethylbenzyl)-5-{3',5'-di(α,α-dimethylbenzyl)-4'-hydroxybenzyl} salicylic acid, 3-tert-butyl-5-(α,α-dimethyl-3',5'-di-tert-butyl-4'-hydroxy-benzyl) salicylic acid, 5-(α,α-dimethyl-3'-carboxy-4'-hydroxybenzyl) salicylic acid, 5-(α,α-dimethyl-4'-hydroxybenzyl) salicylic acid, 3-(2'-hydroxyphenoxy) salicylic acid, 3-(2'-hydroxy-3'-carboxyphenoxy) salicylic acid, 3-(2'-hydroxy-3'-carboxy-5'-tert-butylphenoxy)-5-tert-butyl-salicylic acid, 3-(2'-hydroxy-3',5'-di-tert-butylphenoxy-5-tert-butyl-salicylic acid, 3-{2'-hydroxy-3'-carboxy-5'(α,α-dimethyl-benzyl)phenoxy}-5-(α,α-dimethylbenzyl) salicylic acid, 3-{2'-hydroxy-3',5'-di(α,α-dimethylbenzyl) phenoxy}-5-(α,α-dimethylbenzyl) salicylic acid or 3-(2'-hydroxy-3',5'-dicyclohexylphenoxy)-5-cyclohexyl-salicylic acid.

Furthermore, a large number of aromatic carboxylic acids of general formula II which are difficult to express in the chemical nomenclature are said to be useful for the purposes of U.S. Pat. No. 4,134,847. For instance, there are indicated condensation products of formaldehyde with salicylic acid or nucleus-substituted salicylic acids and phenols, salicylic acid or nucleus-substituted salicylic acid adducts of propylene polymer or isobutylene polymer, salicylic acid or nucleus-substituted salicylic acid adducts of benzylchloride poly-condensation products, salicylic acid or nucleus-substituted salicylic acid adducts of styrene polymers, salicylic acid or nucleus-substituted salicylic acid adducts of α-methylstyrene polymers, salicylic acid or nucleus-substituted salicylic acid condensates of aldehydes or acetylene, salicylic acid or nucleus-substituted salicylic acid condensates of ketones, and salicylic acid or nucleus-substituted salicylic acid adducts of compounds having an unsaturated bond.

The organic polymers which U.S. Pat. No. 4,134,847 discloses for mixture with these acids include polymers of α-methyl styrene. U.S. Pat. No. 4,199,619 discloses use of organic acceptors including various aromatic carboxylic acids such as benzoic acid, p-tert-butyl-benzoic acid, 4-methyl-3-nitro benzoic acid, salicylic acid, 3-phenyl salicylic acid, 3-cyclohexyl salicylic acid, 3-tert-butyl-5-methyl salicyclic acid, 3,5,-di-tert-butyl salicylic acid, 3-methyl-5-benzyl salicylic acid, 3-phenyl-5-(α,α-dimethylbenzyl) salicylic acid, 3-cyclohexyl-5-α,α-dimethylbenzyl) salicylic acid, 3-(α,α-dimethylbenzyl)-5-methyl salicylic acid, 3,5-dicyclohexyl salicylic acid, 3,5-di(α-methylbenzyl) salicylic acid, 3,5-di(α,α-dimethylbenzyl) salicylic acid, 3-(α-methylbenzyl)-5-(α,α-dimethylbenzyl) salicylic acid, 4-methyl-5-cyclohexyl salicylic acid, 2-hydroxy-1-benzyl-3-naphthoic acid, 1-benzoyl-2-hydroxy-3-napthoic acid, 3-hydroxy-5-cyclohexyl-2-naphthoic acid and the like, and polyvalent metallic salts thereof such as zinc salts, aluminum salts, magnesium salts, calcium salts and cobalt salts as disclosed in U.S. Pat. No. Nos. 3,864,146, 3,924,027 and 3,983,292.

U.S. Pat. No. 4,219,219 discloses the use of (i) developers comprising a polyvalent metal salt of a substituted salicylic acid represented by the following general formula (I) or (II) and (ii) developers comprising a polyvalent metal salt of a substituted salicylic acid represented by the following general formula (I) or (II) and one or more oxides, hydroxides, carbonates or carboxylic acid salts of zinc, aluminum, titanium, silicon, boron, magnesium and calcium or inorganic pigments such as activated clay, kaolin talc and the like:

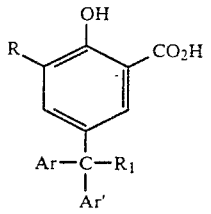

(I)

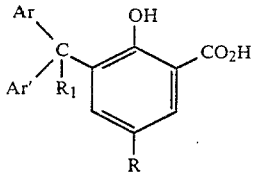

(II)

wherein R represents a hydrogen atom an alkyl group, an aralkyl group or an aryl group, $R_1$ represents a hydrogen atom, an alkyl group, an aralkyl group or an aryl group and Ar and Ar' which may be the same or different, each represents an aryl group.

U.S. Pat. No. 4,234,212 discloses a recording sheet coated with a color developer obtained from a dispersion containing a melamine resin and/or a urea resin, a polyvalent metal salt of an aromatic carboxylic acid and a water-soluble polymer containing hydroxyl groups.

Suitable polyvalent metal salts of aromatic carboxylic acids which can be employed include those polyvalent metal salts of aromatic carboxylic acids represented by the following general formula (I):

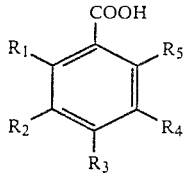

(I)

wherein $R_1$, $R_2$, $R_3$, $R_4$ and $R_5$, which may be the same or different, each may have up to 18 carbon atoms and represents, for example, a hydrogen atom, a halogen atom (e.g., a chlorine atom or a bromine atom), a hydroxy group, an amino group, an alkylamino group (e.g., an alkylamino group substituted with one or two alkyl groups containing 1 to 12 carbon atoms, such as a methylamino group, an ethylamino group, an isobutylamino group, an octylamino group, a dodecylamino group, a diethylamino group, a dibutylamino group, a di-2-ethylhexylamino group, an N-ethyl-N-octylamino group, etc.), a nitro group, an aldehyde group, an alkyl group (e.g., an alkyl group containing 1 to 12 carbon atoms, such as a methyl group, an ethyl group, a butyl group, an octyl group, a t-butyl group, a dodecyl group, etc.), a cycloalkyl group (e.g., a cycloalkyl group containing 5 to 7 carbon atoms, e.g., a cyclohexyl group, a methylcyclohexyl group, etc.), an aryl group (e.g., an aryl group containing 6 to 10 carbon atoms, such as a phenyl group, a naphthyl group, etc.), an alkylaryl group (e.g., a phenyl group or a naphthyl group substituted with one or more alkyl groups containing 1 to 12 carbon atoms, such as a methylphenyl group, an ethylphenyl group, a 2,4-di-t-amylphenyl group, an octylphenyl group, a dodecylphenyl group, a methylnaphthyl group, etc.), an aralkyl group (e.g., an aralkyl group containing 7 to 20 carbon atoms, such as a benzyl group, a phenethyl group, a methylbenzyl group, etc.), an alkoxy group (e.g., an alkoxy group containing 1 to 12 carbon atoms, such as an ethoxy group, a methoxy group, a butoxy group, etc.), and so on. Also, $R_1$ and $R_2$, $R_3$ and $R_4$ and/or $R_4$ and $R_5$ may combine and form a 5- or a 6-membered ring (e.g., a 5- or 6-membered carbon-containing ring).

Of the compounds represented by the abovedescribed general formula (I), those compounds in which at least either $R_1$ or $R_5$ is a hydroxy group and which are substituted with an alkyl group, an aryl group, an aralkyl group or other groups in positions ortho and para to such a hydroxy group, are especially useful in the present invention.

Specific examples of aromatic carboxylic acids represented by the general formula (I) include 2,4-dichlorobenzoic acid, p-isopropylbenzoic acid, 2,5-dinitrobenzoic acid, p-t-butylbenzoic acid, N-phenylanthranilic acid, 4-methyl-3-nitrobenzoic acid, salicylic acid, m-hydroxybenzoic acid, p-hydroxybenzoic acid, 3,5-dinitrosalicylic acid, 5-t-butyl-salicylic acid, 3-phenylsalicylic acid, 3-methyl-5-t-butylsalicylic acid, 3,5-di-t-amylsalicylic acid, 3-cyclohexylsalicylic acid, 5-cyclohexylsalicylic acid, 3-methyl-5-isoamylsalicylic acid, 5-isoamylsalicylic acid, 3,5-di-sec-butylsalicylic acid, 5-nonylsalicylic acid, 2-hydroxy-3-methylbenzoic acid, 2-hydroxy-5-t-butylbenzoic acid, 2,4-cresotinic acid, 5,5-methylenedisalicylic acid, acetoamino-benzoic acids (o-, m- and p-), 2,4 dihydroxybenzoic acid, 2,5-dihydroxybenzoic acid, anacardic acid, 1-naphthoic acid, 2-naphthoic acid, 1-hydroxy-2-naphthoic acid, 2-hydroxy-3-naphthoic acid, 2-hydroxy-1-naphthoic acid, thiosalicylic acid and the like. Preferred examples of aromatic carboxylic acids represented by the general formula (I) include 3,5-di(α-methyl-benzyl)salicylic acid, 3-(α-methylbenzyl)-5-α,α-dimethyl-benzyl)salicylic acid, 3-(4'-α-dimethylbenzyl)phenyl-5-(α,α-dimethylbenzyl)salicylic acid, 3,5-di-t-butylsalicylic acid, 3,5-di-5-octylsalicylic acid, 3-cyclohexyl-5-(α,α-dimethylbenzyl)salicylic acid, 3-phenyl-5-(α,α-dimethylbenzyl)-salicylic acid, 3,5-di(α,α-dimethylbenzyl)-salicylic acid and so on.

Suitable polyvalent metals forming salts with the above-described aromatic carboxylic acids which are disclosed in U.S. Pat. No. 4,234,212 are, for example, magnesium, aluminum, calcium, scandium, titanium, vanadium, chromium, manganese, iron, cobalt, nickel, copper, zinc, gallium, germanium, strontium, yttrium, zirconium, molybdenum, silver, cadmium, indium, tin, antimony, barium, tungsten, lead, bismuth and so on. Of these metals, especially effective polyvalent metals include zinc, tin, aluminum, magnesium, calcium and the like. The most preferred polyvalent metal is zinc.

In the compositions of U.S. Pat. No. 4,234,212, a specific binder is employed in preparing a coating solution containing a color developer. The binder is selected depending upon the strength of the film which the binder forms, the dispersibility of the color developer to be employed into the binder, and the extent of influence of the binder upon the color development capability of the color developer.

Examples of suitable water-soluble polymers which can be used as binders include water-soluble binders where crystals and cross-linking are not present and containing hydroxyl groups, carboxyl groups, sulfo groups, or salts thereof, for example, natural macromolecular compounds such as proteins (e.g., gelatin, albumin, casein, etc.), starches (e.g., cereal starch, α-starch, oxidized starch, etherified starch, esterified starch, etc.), celluloses (e.g., carboxymethyl cellulose, hydroxymethyl cellulose, etc.), saccharides (e.g., agar, sodium alginate, carboxymethyl starch, gum arabic, etc.) and the like, and water-soluble, synthetic high polymers, such as polyvinyl alcohol (PVA), polyvinyl pyrrolidone, polyacrylic acid, polyacrylamide, maleic acid copolymers and the like.

Examples of suitable latex binders disclosed by U.S. Pat. No. 4,234,212 include styrene-butadiene latex (SBR), acrylonitrile-butadiene latex, acrylic acid type latexes, vinyl acetate type latexes, methylmethacrylate-butadiene latex, and the carboxy denatured latexes thereof.

U.S. Pat. No. 4,374,671 discloses a process for producing a color developer in which zinc oxide is combined with at least one acid selected from the group consisting of salicylic acid and nuclear substituted salicylic acids and at least one metal silicate as an inorganic pigment. The salicylic acid compound used in U.S. Pat. No. 4,374,671 can be represented by the following general formula:

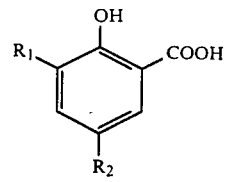

wherein $R_1$ and $R_2$ represents hydrogen, chlorine, a saturated and unsaturated alkyl group having 1 to 15 carbon atoms, a phenyl group, a cyclohexyl group, a phenyl alkyl group having 7 to 21 carbon atoms, an $alkyl^1$ phenyl $alkyl^2$ group wherein the $alkyl^1$ and $alkyl^2$ groups have 1 to 15 carbon atoms, a 1-hydroxy-2-carboxy benzyl group and a 4-hydroxy-3-carboxy benzyl group.

The nuclear substituted salicylic acid includes, for example, 5-tert-butylsalicylic acid, 3-phenylsalicylic acid, 3-methyl-5-tert-butylsalicylic acid, 3,5-di-isopropylsalicylic acid, 3,5-di-tert-butylsalicylic acid, 3,5-di-tert-amylsalicylic acid, 3-cyclohexylsalicylic acid, 5-cyclohexylsalicylic acid, 3-methyl-5-isoamylsalicylic acid, 5-isoamylsalicylic acid, 3,5-di-sec-butylsalicylic acid, 5-laurylsalicylic acid, 3-methyl-5-laurylsalicylic acid, 3-methylsalicylic acid, 2-4-cresotonic acid, 2,5-cresotonic acid, 2,3-cresotonic acid, 4-hydroxysalicylic acid, 5-hydroxysalicylic acid, 6-hydroxysalicylic acid, 5,5'-methylenesalicylic acid, anacardic acid, 5-benzylsalicylic acid, 3,5-bis-(2-phenyl-isopropyl) salicylic acid, 3-(2-phenyl-isopropyl)-5-methylsalicylic acid, 4-chlorosalicylic acid, etc.

Developer materials of the type described in these patents are not satisfactory for the image forming systems described in U.S. Pat. No. 4,440,846. For the purposes of such imaging systems, it is desirable for the developer to provide a number of related properties, including the following:

1. Glossing. When the image is processed by heating, it is desirable for the developer to be capable of forming a glossy surface. It is important that the developer be capable of glossing at a temperature which is not inconsistent with temperatures which are suitable for other materials in the imaging material.

2. Transparency. The developer must be transparent in the areas which do not develop a visible image. This is particularly important in imaging systems coated onto a transparent backing, for use in producing transparencies.

3. The refractive index of the developer must be similar to that of other materials on the imaging sheet.

4. The density of the image produced by the developed image should be high.

5. The color purity must be high.

6. The resolution of the image must be high.

7. The developer must have a high enough softening temperature that it is not glossed during coating of the product on a support, during manufacture.

8. The developer should not produce a yellow background in non-imaged areas.

9. The developed image should not fade.

10. The developer should not emit toxic vapors either at normal temperatures or at the elevated temperatures used for glossing.

11. The developer must adhere well to the support materials used for the imaging system, especially oriented polyester film used for transparency materials.

12. The developer must be capable of forming a fine dispersion, so that, prior to development, the particles of developer on the support will be small.

13. The developer must be capable of forming a dispersion which is easily coated.

14. The developer must have good shelf-life prior to formation of an image and development. In particular, the coated substrate must be nonblocking.

15. The developer must not undergo yellowing prior to development.

16. The developer must not cause problems with sheet feeding mechanisms used for automated imaging apparatus.

SUMMARY OF THE INVENTION

In accordance with the present invention, phenol-/aldehyde condensation products useful in the development of colored images from colorless dye are produced by the interaction of an alkyl-substituted salicylic acid, an alkyl-substituted phenol, an aldehyde and a metal source.

The phenol/aldehyde condensation product is synthesized by combining and then heating the alkyl-substituted salicylic acid, the alkyl-substituted phenol, the aldehyde, the metal source and water. After the reaction has occurred, the mixture is cooled and then filtered to obtain the phenol/aldehyde condensation product.

DETAILED DESCRIPTION OF THE INVENTION

The developers of the present invention are particularly useful in a photosensitive imaging system in which images are formed by image-wise reaction of one or more chromogenic materials with the developer, and in carbonless copy paper systems.

The presently disclosed developers are produced by the interaction of an alkyl-substituted salicylic acid, an alkyl-substituted phenol, an aldehyde and a metal source to form a phenol/aldehyde condensation product.

The alkyl-substituted salicylic acid is preferably substituted with at least one alkyl group containing three or more carbon atoms. Desirably, the alkyl group contains at least four carbon atoms, especially four to twelve carbon atoms. Particularly useful are salicylic acids of the formula:

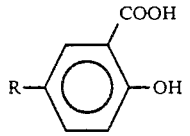

where R is an alkyl group containing from four to twelve carbon atoms. In particular, the group R is octyl or nonyl, especially tertiary-octyl (derived from diisobutene) and nonyl (derived from propylene trimer). The group R may also be a dodecyl group. The currently preferred materials use the nonyl group.

The alkylphenol component preferably contains at least one alkyl group containing at least three carbon atoms, especially four to twelve carbon atoms. In particular, the phenols are phenols substituted in the para-position with an alkyl group containing four to twelve carbon atoms, particularly tertiary-butyl, tertiary-octyl, nonyl (derived from propylene trimer) and dodecyl. The currently preferred materials use the tertiary-octyl group.

The aldehyde is preferably formaldehyde, although the formaldehyde may be supplied, for example, from paraformaldehyde or a similar source of formaldehyde.

The preferred metal source is zinc oxide.

The exact composition of the product is not known, but it is believed to have the general formula:

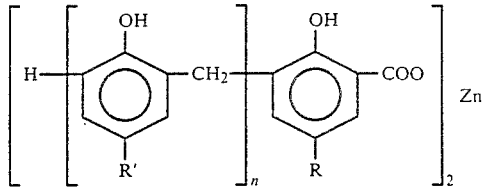

The phenol/aldehyde condensation product may be synthesized by combining and heating the alkyl-substituted salicylic acid, the alkyl-substituted phenol, the aldehyde, the metal source and water. The following is a general example of a suitable manufacturing process:

750 parts nonylsalicylic acid, 523 parts p-t-octylphenol, 199 parts 50% formaldehyde solution, 3 parts of Daxad 30 (a wetting agent of proprietary composition available from W. R. Grace & Co.), 69 parts water and 103 parts of zinc oxide are heated to reflux with agitation. After the reaction takes place, heating is discontinued and additional wetting agent is added. The mixture is cooled with agitation, and further diluted with water. The mixture is then filtered to obtain the phenol/aldehyde condensation product.

The following examples serve to illustrate the manufacturing process of the present invention in greater detail. Carbonless copy paper testing of the produced image developers is also described. In addition, variations of the percent content of alkyl-substituted salicylic acid to alkyl-substituted phenol are considered. These examples are included for illustrative purposes and should not be considered to limit the present invention.

EXAMPLE 1

Carboxylation of Alkylphenols 1320 parts p-nonyl phenol, 1200 parts xylene, and 240 parts sodium hydroxide pellets were added to a kettle with agitation. The batch was heated until the removal of water by azeotropic distillation was complete at 144° to 146° C. The batch was then cooled to 125° C. and carbon dioxide was introduced via a subsurface sparge to a pressure of 100 psig. These conditions were maintained for ten hours. The batch was then cooled to less than 100° C. and the carbon dioxide pressure was released. 400 parts of water were added, then the batch was neutralized with 900 parts of 20% hydrochloric acid. The pH was adjusted to 1 to 2 with 1 to 100 parts of 20% hydrochloric acid. When a pH of 1 to 2 was achieved, agitation was terminated and the batch was allowed to phase separate. The water layer was removed, and 500 parts of water were added with agitation. The batch was heated to 80° to 90° C., then allowed to phase separate. Again, the water layer was removed, and the organic layer was washed with 500 parts of water and allowed to phase separate. The final water wash layer was removed and the remaining organic layer was vacuum distilled at 26 inches Hg to 160° C. The batch was cooled to yield the final product as a very viscous, dark-amber transparent liquid which solidified or formed crystals at temperatures below 30° C. The product, nonylsalicylic acid (NSA), had an acid number of 180 to 204 and a conversion of 85.5 to 97.6%. The nonylsalicylic acid was ready for use in the aldehyde condensation reactions described below.

According to the same general procedure described above, dodecylphenol was carboxylated to provide a raw material suitable for use in the aldehyde condensation reactions of the present invention. The carboxylation procedure took place at the same time, temperature and pressure parameters described above. The product, dodecylsalicylic acid, had an acid number of 163 to 184 and a conversion of 85 to 96%.

EXAMPLE 2

Aldehyde Condensation Reactions

The aldehyde condensation reactions of the present invention produced a product which was in both dispersed and solid form.

1. Dispersions 238 parts of nonylsalicylic acid, 166 parts of p-t-octylphenol, and 60 parts of 50% formaldehyde were added to a kettle with agitation. The batch was heated to a temperature in the range of 120° to 125° C. At 120° C., a slurry of 21.9 parts of water, 1 part of a sodium salt of a proprietary electrolyte supplied by W. R. Grace, and 32.7 parts of zinc oxide were added. The batch was heated to atmospheric reflux and maintained at reflux until the free formaldehyde content of the batch was less than or equal to 0.2%. At this point, 19.8 parts of polyvinyl alcohol and 55 parts of water were added to the batch. When phase inversion occurred and particle size distribution was acceptable, letdown water was added to adjust solids as desired. The batch was then filtered through a 100 micron filter to yield the final dispersion product.

The final dispersion product was a white, smooth, slightly viscous liquid. The product had a pH of 5.4 to 6.4, a viscosity of 20 to 1300 centipoise, non-volatiles of 50 to 60%, and a Tg of 45 to 65.

Using the same general procedure described above, p-nonylphenol, p-t-butylphenol, and dodecylphenol each replaced p-t-octylphenol as the alkyl-substituted phenol in the aldehyde condensation procedure.

Other parameters which were varied while continuing to yield a product which satisfied performance requirements were as follows:

1. The alkyl-substituted salicylic acid content in the batch was varied within the range of from 30 to 75 molar % of the total phenol content.
2. The zinc content in the batch was varied within the range of from 3.88 to 15.11% by weight of the final resin content.
3. The formaldehyde content in the batch was varied within the range of from 0.25 to 0.70 molar ratio formaldehyde to total phenol content.

2. Solid Resins (a) 238 parts of nonylsalicylic acid, 166 parts of p-t-octyl phenol, and 60 parts of 50% formaldehyde were added to a kettle with agitation. The batch was heated to a temperature in the range of 120° to 125° F. At 120° F., a slurry of 21.9 parts of water, 1 part of a sodium salt of a proprietary electrolyte supplied by W. R. Grace, and 32.7 parts of zinc oxide were added. The batch was heated to atmospheric reflux and maintained at reflux until the free formaldehyde content of the batch was less than or equal to 0.2%. The batch was then distilled to 160° C. at 24 inches vacuum and held for 15 minutes.

The final product was a dark-amber, solid resin. The resin had a ball and ring melt point of 125° to 133° C.

Using the same general procedure described above, p-nonylphenol, p-t-butylphenol and dodecylphenol each replaced p-t-octyl phenol as the alkyl substituted phenol in the aldehyde condensation procedure. In each case, a solid resin was obtained which satisfied performance requirements.

(b) 238 parts of nonylsalicylic acid, 166 parts of p-t-octylphenol, and 1.4 parts of a mixed p-toluene sulfonic acid and p-xylene sulfonic acid supplied by Witco Chemicals were added to a kettle with agitation. The batch was heated to a temperature in the range of 75° C. to 95° C. At 75° C., 60 parts of 50% formaldehyde was added. The batch was heated to atmospheric reflux and maintained at reflux until the free formaldehyde content of the batch was less than or equal to 0.2%. At this point, a slurry of 21.9 parts of water, 1 part of a sodium salt of a proprietary electrolyte supplied by W. R. Grace, and 27.8 parts of zinc oxide were added. The batch was held at atmospheric reflux for 2 hours. The batch was then distilled to 160° C. at 24 inches vacuum and held for 15 minutes.

The final product was a dark-amber, solid resin. The resin had a ball and ring melt point of 125° C. to 135° C.

EXAMPLE 3

Carbonless Copy Paper Test Procedures

The performance of the obtained phenol/aldehyde condensation products in developing colored images from colorless dyes was evaluated by performing carbonless copy paper testing on samples of the products in both dispersed and solid form.

According to usual procedures, the samples were first combined with other components of a waterbased coated front (CF) sheet coating formulation. The formulation was then coated on a sheet of paper.

The test coating formulation was typical of the CF formulations used by the carbonless copy paper industry. All resins were in the dispersed form. Other components of the coating formulation were in slurry form.

The CF coating formulation was prepared in the following manner:

| | Slurry Composition | |
|---|---|---|
| Components | Wet Weight, g | Solid Weight, g |
| Kaolin Clay | 43.0 | 30.0 |
| Calcium Carbonate | 62.5 | 45.0 |
| Penford Gum 280 Starch | 30.0 | 6.0 |
| Dow 620 Latex | 8.0 | 4.0 |
| Water | 36.0 | |

When all the components were combined and mixed, the resulting slurry was homogeneous. The amount of resin dispersion to be added to the coating slurry was calculated as 2.5 grams divided by the resin's active resin content. This amount of resin dispersion was added to 23.9 grams of slurry. Water was then added to bring the total solution weight to 83.3 grams. After sufficient agitation, the slurry was ready for coating.

The slurry was drawn down on a sheet of paper to create a coated front sheet according to the following procedure: Using a pipette, a bead of slurry was drawn along a #14 Meyer Rod across the paper to be coated. The paper was then drawn smoothly from under the rod, coating the paper. The coated samples were dried for a minimum of twenty minutes and were then ready for carbonless copy paper testing.

Carbonless copy paper testing on the coated samples included calender intensity, 3-day oven aging at 140° C. and 5-day lightbox aging.

EXAMPLE 4

Calender Intensity

A coated front sheet and a coated back sheet were placed face to face and passed through the nip of a two roll calender to create an image. A BNL-2 Opacimeter sold by Technidyne Corp. was used to determine image intensity and the speed of image development (print speed). Image intensity was expressed as the ratio of the reflectance from the imaged area to the reflectance from a white standard:

$$\text{Image Intensity: } \frac{\text{Image Relectance}}{\text{White Reflectance}} \times 100$$

The coated samples were calendered and the imaged surface read in one spot with the opacimeter at intervals of 20, 40 and 50 seconds. One minute and one hour readings were taken in five spots and reported as averages. Image intensity was measured on a scale of 1 to 100, with the lower numbers being the more intense values.

The samples of the present invention were compared to HRJ-4002, an industrial standard dispersion (manufactured by Schenectady Chemicals, Inc.) used by the carbonless copy paper industry. The results are summarized in Table 1.

TABLE 1

| | | Calender Intensity | | | | |
|---|---|---|---|---|---|---|
| Product | Disp/ Solid | 20 sec | 40 sec | 50 sec | 1 min | 1 hr |
| PTBP + NSA | S | 35.4 | 33.2 | 32.4 | 30.6 | 25.5 |
| PTOP + NSA | S | 33.7 | 32.4 | 32.2 | 32.2 | 28.4 |
| PTBP + DSA | S | 32.3 | 30.0 | 29.5 | 28.7 | 25.5 |
| PTBP + NSA | D | 33.1 | 30.9 | 30.4 | 29.4 | 25.5 |
| PTOP + NSA | D | 30.2 | 29.2 | 29.0 | 28.7 | 25.5 |
| PTBP + DSA | D | 29.4 | 28.4 | 27.9 | 27.6 | 25.1 |
| HRJ-4002 | D | 33.3 | 31.4 | 31.2 | 30.5 | 27.8 |

PTBP = p-t-butylphenol
NSA = nonylsalicylic acid
PTOP = p-t-octylphenol
DSA = dodecylsalicylic acid Prior to the present invention, HRJ-4002 produced the best results as an industrial standard in carbonless copy paper testing. However, a review of the above data, as well as the data in the following Tables, indicates that the presently disclosed phenol/aldehyde condensation products are, for the most part, better than or equal to HRJ-4002 in performance.

The calender intensity values of Table 1 show that in every case, the presently disclosed dispersions performed better in calender intensity testing that did HRJ-4002. The resins performed at least as well as HRJ-4002, with PTBP+DSA resin performing slightly better than HRJ-4002.

EXAMPLE 5

Oven Aging

This test measured the degree to which exposure of an unimaged CF sheet of carbonless paper to an elevated temperature affected its ability to develop an image.

Unimaged samples were aged in an oven for three days at 140° C. After oven aging was complete, the samples were imaged by calendering with a coated back (CB) sheet and tested for print speed and image intensity with an opacimeter. Measurements were taken at 20, 40 and 50 second intervals after calendering. One minute and 1 hour readings were taken five times each at different spots of the sample and reported as an average of the five individual measurements. These intensity measurements at various time intervals were compared with intensity measurements of freshly coated samples taken at identical time intervals. The loss of image intensity after oven aging was reported as a decline in image performance after heat aging. The results are summarized in Table 2.

TABLE 2

| | | 3-Day Oven Aging at 140° C. | | | | |
|---|---|---|---|---|---|---|
| Product | Disp/ Solid | 20 sec | 40 sec | 50 sec | 1 min | 1 hr |
| PTBP + NSA | S | 38.6 | 35.0 | 34.0 | 34.1 | 26.4 |
| PTOP + NSA | S | 36.2 | 33.4 | 32.7 | 34.3 | 27.6 |
| PTBP + DSA | S | 36.8 | 33.9 | 33.0 | 32.3 | 25.9 |
| PTBP + NSA | D | 43.7 | 38.0 | 36.0 | 34.7 | 25.9 |
| PTOP + NSA | D | 33.3 | 30.8 | 29.9 | 30.0 | 25.5 |
| PTBP + DSA | D | 36.6 | 34.0 | 33.2 | 33.7 | 27.4 |
| HRJ-4002 | D | 37.1 | 34.1 | 33.3 | 38.9 | 27.8 |

A review of Table 2 shows that the presently disclosed dispersions were better or equal in performance to HRJ-4002 following 3-day oven aging at 140° C. As to the resins, their performance was equal to that of HRJ-4002.

EXAMPLE 6

Lightbox Aging

This test was carried out according to ASTM's F 767-82 test method: "Image Stability of Chemical Carbonless Paper to Light." ASTM (American Society for Testing and Materials) describes this test method as determining the "image stability of chemical carbonless paper by exposure to fluorescent light for a controlled time period."

Imaged samples were tested for image intensity on the opacimeter for use as a baseline. These imaged samples were then subjected to five days in a fluorescent lightbox as specified according to the ASTM F 767-82 test method. Intensity values were again determined with the opacimeter. The magnitude of the difference between initial intensity values and image intensity after lightbox exposure was taken as the measure of the degree of image fade. These results are shown in Table 3.

TABLE 3

| | | 5-Day Lightbox Aging | | |
|---|---|---|---|---|
| Product | Disp/Solid | Unexposed | Exposed | Change |
| PTBP + NSA | S | 26.8 | 29.9 | 3.1 |
| PTOP + NSA | S | 28.7 | 33.3 | 4.6 |
| PTBP + DSA | S | 26.9 | 28.7 | 1.8 |
| PTBP + NSA | D | 26.9 | 29.6 | 2.7 |
| PTOP + NSA | D | 28.2 | 31.2 | 3.0 |
| PTBP + DSA | D | 27.9 | 29.9 | 2.0 |
| HRJ-4002 | D | 32.3 | 32.7 | 0.4 |

It is clear from the above data that the lightbox aging results greatly favored the presently disclosed dispersions and resins over the conventional HRJ-4002. Even though HRJ-4002 showed the least amount of change, or fade, the images for all the dispersions and resins performed better, or were darker, than both the exposed and unexposed test sheets of HRJ-4002. In other words, even the exposed values of the presently disclosed dispersions and resins performed better than the unexposed values of HRJ-4002.

EXAMPLE 7

NSA Variations

The percentage of nonylsalicylic acid to total phenol content (alkyl phenols plus nonylsalicylic acid) was varied to optimize the performance and cost effectiveness of the presently disclosed phenol/aldehyde condensation products. The procedures for these reactions were identical to those of Examples 1 and 2 described above.

Carbonless copy paper testing was performed on the obtained products with nonylsalicylic acid contents of 30, 40, 50 and 75 percent of the total phenols content. Testing consisted of calender intensity measurements, oven aging, lightbox aging, YI 313 measurements and color shift determinations. The same general procedures described in Examples 4 through 6 above (with the specific parameters given in Tables 4 through 6) were used in calender intensity testing, oven aging and lightbox aging.

The YI 313 method was used to measure background yellowing and report it as a numerical value or "yellowness index." YI 313, a test method developed by ASTM, is described by ASTM as "the attribute by which an object color is judged to depart from a preferred white toward yellow."

According to this method, a Hunter Colorquest Spectrophotometer was used to measure the reflectance spectrum of a sample of freshly coated CF paper. Then, by means of computer software, the "yellowness index", or YI 313 value, was calculated according to the formula specified in ASTM's YI 313 method.

The sample was then placed in a lightbox containing fluorescent bulbs of the type described in ASTM's test method F 767-82. The sample was exposed to the fluorescent light for five days, then removed from the lightbox. The yellowness index or YI 313 value was again measured using the Hunter Colorquest Spectrophotometer. The difference in the YI 313 value of the test CF sheet before and after lightbox exposure was taken as the measure of the degree of yellowing of the unimaged coating when exposed to light.

Color shift was also determined using a Hunter Colorquest Spectrophotometer. The results of this test are from the L, a, and b scales based on the opponent-colors theory of color visions. Color shift testing requires a baseline and was performed on imaged samples. After baseline values were determined, the samples were subjected to lightbox aging, according to standard methods described above. New L, a, and b values were determined after lightbox aging and changes in color, as expressed by changes in the L, a, b values, were noted.

Calender intensity measurements, oven aging, lightbox aging, YI 313 measurements and color shift determinations are carbonless copy paper test methods widely used by the industry. These tests are designed to measure what are considered to be some of the important attributes of carbonless copy paper, i.e., print speed, image intensity, and fading or color change due to the environment.

The results of the tests on phenol/aldehyde condensation products with nonylsalicylic acid contents of 30, 40, 50 and 75 percent are summarized in Tables 4 through 8 below.

TABLE 4

| | Calender Intensity | | | | |
|---|---|---|---|---|---|
| Resin | 1 min | 5 min | 20 min | 1 hr | 24 hr |
| 30% NSA | 30.6 | 28.8 | 27.2 | 26.7 | 26.3 |
| 40% NSA | 29.7 | 28.2 | 27.7 | 27.2 | 26.3 |
| 50% NSA | 29.2 | 28.1 | 27.1 | 26.7 | 26.2 |
| 75% NSA | 40.4 | 31.2 | 29.0 | 28.2 | 27.1 |

TABLE 5

| | 72-Hour Oven Aging | | | | |
|---|---|---|---|---|---|
| Resin | 1 min | 2 min | 20 min | 1 hr | 24 hr |
| 30% NSA | 32.9 | 30.8 | 29.6 | 29.0 | 28.1 |
| 40% NSA | 28.3 | 27.1 | 26.2 | 25.6 | 25.7 |
| 50% NSA | 31.3 | 28.0 | 27.0 | 26.7 | 26.9 |
| 75% NSA | 50.4 | 41.4 | 33.0 | 28.7 | 26.5 |

TABLE 6

| | 5-Day Lightbox Aging | | |
|---|---|---|---|
| Resin | Before | Light Fade | Change |
| 30% NSA | 26.3 | 32.5 | 3.8 |
| 40% NSA | 26.4 | 33.8 | 7.4 |
| 50% NSA | 26.2 | 33.0 | 6.8 |
| 75% NSA | 27.1 | 34.7 | 7.6 |

TABLE 7

| | YI-313 (Background Yellowing-Unimaged-Lightbox) | | |
|---|---|---|---|
| Resin | Before | Light Fade | Change |
| 30% NSA | 5.86 | 8.40 | 2.55 |
| 40% NSA | 5.89 | 9.77 | 3.88 |
| 50% NSA | 5.79 | 9.66 | 3.87 |
| 75% NSA | 5.92 | 9.40 | 3.48 |

TABLE 8

| | Color Shift (5-Day Lightbox-Imaged) | | | | | |
|---|---|---|---|---|---|---|
| | Before Lightbox | | | Light Fade | | |
| Resin | L | a | b | L | a | b |
| 30% NSA | 40.29 | 2.71 | −2.91 | 53.34 | 9.16 | −3.33 |
| 40% NSA | 49.18 | 2.14 | −3.33 | 53.31 | 10.17 | −3.54 |
| 50% NSA | 50.03 | 1.53 | −3.31 | 52.66 | 9.41 | −3.91 |
| 75% NSA | 50.30 | 2.38 | −3.68 | 54.31 | 10.56 | −3.22 |

| | Change | | |
|---|---|---|---|
| Resin | L | a | b |
| 30% NSA | 4.05 | 6.46 | −0.42 |
| 40% NSA | 4.13 | 8.03 | −0.21 |
| 50% NSA | 2.63 | 7.89 | −0.61 |
| 75% NSA | 4.01 | 8.18 | 0.46 |

As is clear from the above data, varying the percentage of nonylsalicylic acid to total phenol content has little or no effect on the performance of the phenol/aldehyde condensation product, except for very high levels of nonylsalicylic acid (75% nonylsalicylic acid). 30 and 40% nonylsalicylic acid results are identical to 50% nonylsalicylic acid results in calendar intensity, lightbox aging, and YI-313 measurements. Oven age testing indicated 40% nonylsalicylic acid is slightly better in performance than 50% nonylsalicylic acid.

The results from this series of carbonless copy paper testing indicate no detrimental effects on the performance of phenol/aldehyde condensation products with substantially lower percentages of nonylsalicylic acid.

The invention having been described, it will be appreciated by those skilled in the art, that various modifications can be made within the scope of the following claims.

What is claimed is:

1. In a system in which images are formed selectively in parts of a surface in the form of a colored material by the reaction of one or more colorless chromogenic materials with an acidic developer;

the improvement in which the developer contains a phenol/aldehyde condensation product produced by the reaction together of an alkyl-substituted salicylic acid, an alkyl-substituted phenol, and an aldehyde which condensation product has been reacted with a metal source.

2. In a system in which images are formed selectively in parts of a surface in the form of a colored material by the reaction of one or more colorless chromogenic materials with an acidic developer;

the improvement in which the developer contains a phenol/aldehyde condensation product produced by the reaction together of an alkyl-substituted salicylic acid, an alkyl-substituted phenol, an aldehyde and a metal source.

3. The system of claim 1 in which images are formed by image-wise exposure of a photosensitive encapsulate containing a chromogenic material to actinic radiation and rupture of the capsules in the presence of a developer whereby a patterned reaction of the chromogenic material and developer is obtained which produces a contrasting image.

4. The system of claim 1 in which images are formed by the application of pressure selectively to microcapsules containing a chromogen in parts of said surface whereby the microcapsules are ruptured in the presence of a color developer, thus releasing the chromogen which reacts with the color developer to form an image at the point of pressure.

5. The system of claim 1, wherein the alkyl-substituted salicylic acid is substituted with at least one alkyl group containing at least three carbon atoms.

6. The system of claim 5, wherein the alkyl substituted salicylic acid is of the formula:

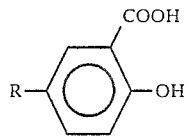

wherein R is an alkyl group containing from 4 to 12 carbon atoms.

7. The system of claim 6, wherein R is an octyl group.

8. The system of claim 7, wherein R is a tertiary-octyl group.

9. The system of claim 6, wherein R is a nonyl group.

10. The system of claim 6, wherein R is a dodecyl group.

11. The system of claim 1, wherein the alkyl-substituted phenol is substituted with at least one alkyl group containing at least three carbon atoms.

12. The system of claim 11, wherein the alkyl substituted phenol is substituted in the para position with an alkyl group containing 4 to 12 carbon atoms.

13. The system of claim 12, wherein the alkyl group is a tertiary-butyl group.

14. The system of claim 12, wherein the alkyl group is a tertiary-octyl group.

15. The system of claim 12, wherein the alkyl group is a nonyl group.

16. The system of claim 12, wherein the alkyl group is a dodecyl group.

17. The system of claim 1, wherein the aldehyde is a formaldehyde.

18. The system of claim 1, wherein the metal source is zinc oxide.

19. In a system in which images are formed selectively in parts of a surface in the form of a colored material by the reaction of one or more colorless chromogenic materials with an acidic developer;

the improvement in which the developer contains a phenol/aldehyde condensation product of the formula:

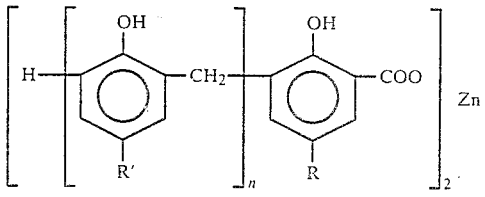

* * * * *